US011268516B2

(12) United States Patent
Lu et al.

(10) Patent No.: US 11,268,516 B2
(45) Date of Patent: Mar. 8, 2022

(54) GAS-LOCK RE-PRIME SHAFT PASSAGE IN SUBMERSIBLE WELL PUMP AND METHOD OF RE-PRIMING THE PUMP

(71) Applicant: BAKER HUGHES, A GE COMPANY, LLC, Houston, TX (US)

(72) Inventors: Xiaonan Lu, Tulsa, OK (US); Risa Rutter, Claremore, OK (US); Zheng Ye, Claremore, OK (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 208 days.

(21) Appl. No.: 16/678,105

(22) Filed: Nov. 8, 2019

(65) Prior Publication Data

US 2020/0158114 A1 May 21, 2020

Related U.S. Application Data

(60) Provisional application No. 62/769,145, filed on Nov. 19, 2018.

(51) Int. Cl.
*F04D 9/00* (2006.01)
*F04D 1/06* (2006.01)
(Continued)

(52) U.S. Cl.
CPC ..... *F04D 9/002* (2013.01); *E21B 43/128* (2013.01); *F04D 1/06* (2013.01); *F04D 7/04* (2013.01); *F04D 9/02* (2013.01); *F04D 13/10* (2013.01)

(58) Field of Classification Search
CPC .... E21B 43/128; E21B 43/38; E21B 33/0355; E21B 43/121; E21B 43/126; F04D 13/10;
(Continued)

(56) References Cited

U.S. PATENT DOCUMENTS 2,311,963 A * 2/1943 Pyle ..... F04D 13/10 417/203
2,956,505 A * 10/1960 Jekat ..... F04D 9/02 415/56.1
(Continued)

FOREIGN PATENT DOCUMENTS

WO 2014176225 A1 10/2014

OTHER PUBLICATIONS

International Search Report and Written Opinion of PCT Application No. PCT/US2019/060738 dated Apr. 8, 2020: pp. 1-7.

*Primary Examiner* — Dominick L Plakkoottam
(74) *Attorney, Agent, or Firm* — Bracewell LLP; Keith Derrington

(57) ABSTRACT

A well fluid centrifugal pump has a shaft passage in the shaft. The shaft passage has an open upper end above the impellers and a closed lower end below the impellers. An outlet port extends laterally from the shaft passage. A gas-lock re-priming device in the shaft passage diverts a portion of well fluid in the discharge adapter bore through the shaft passage and out the outlet port. The re-priming device may be a pressure actuated valve that is biased to a closed position and opens when the pressure in the discharge adapter bore drops below a minimum. Alternately, the re-priming device may be an orifice member with an orifice passage that continuously diverts a portion of the well fluid in the discharge adapter bore out the outlet port.

20 Claims, 4 Drawing Sheets

(51) Int. Cl.

| | |
|---|---|
| ***F04D 7/04*** | (2006.01) |
| ***E21B 43/12*** | (2006.01) |
| ***F04D 13/10*** | (2006.01) |
| ***F04D 9/02*** | (2006.01) |

(58) Field of Classification Search
CPC ..... F04D 1/06; F04D 13/0646; F04D 13/12; F04D 29/708; F04D 7/04; F04D 9/002; F04D 9/007; F04D 9/02; F04B 47/06; F04B 17/03; F04B 53/06; F04B 53/1002; F04B 53/1087; F04B 53/126
See application file for complete search history.

(56) References Cited

U.S. PATENT DOCUMENTS 3,171,630 A * 3/1965 Harney ..... E21B 43/129 415/14
4,684,333 A * 8/1987 Hirakawa ..... F04D 13/025 137/216
4,773,822 A * 9/1988 Jensen ..... F04D 13/0606 415/146
4,867,242 A 9/1989 Hart
5,700,138 A * 12/1997 Bevington ..... F04D 13/0646 417/366
5,845,709 A 12/1998 Mack et al.
6,120,261 A * 9/2000 Al-Towailib ..... F04D 13/10 417/356
6,684,946 B2 2/2004 Gay et al.
6,883,609 B2 4/2005 Drochon et al.
7,134,499 B2 * 11/2006 Wilson ..... E21B 43/121 166/369
7,730,937 B2 * 6/2010 Head ..... F04B 47/06 166/66.4
7,798,215 B2 9/2010 Leuthen et al.
8,028,753 B2 * 10/2011 Shaw ..... E21B 43/128 166/369
9,151,131 B2 * 10/2015 Drablier ..... E21B 43/128
10,107,274 B2 * 10/2018 Noui-Mehidi ..... E21B 43/38
10,378,532 B2 * 8/2019 Brown ..... F04B 47/06
2010/0230091 A1 9/2010 Pugh et al.
2015/0308434 A1 * 10/2015 Crane ..... F04F 5/10 417/54
2016/0201444 A1 * 7/2016 Hardee ..... E21B 43/38 166/265

* cited by examiner

GAS-LOCK RE-PRIME SHAFT PASSAGE IN SUBMERSIBLE WELL PUMP AND METHOD OF RE-PRIMING THE PUMP

CROSS-REFERENCE TO RELATED APPLICATION

This application claims priority to provisional patent application Ser. No. 62/769,145, filed Nov. 19, 2019.

FIELD OF DISCLOSURE

The present disclosure relates to electrical submersible well pump assemblies, and in particular to a pump shaft with an internal passage having a re-priming device to deliver well fluid to lower stages of the pump in the event of gas locking conditions.

BACKGROUND

Electrical submersible pumps (ESP) are commonly used in hydrocarbon producing wells. An ESP includes a pump driven by an electrical motor. The pump is often a centrifugal pump having impellers rotated by a shaft assembly extending from the motor. The well fluid may include pockets of gas, which can cause gas locking of the pump. The pump may lose its prime when gas locked, preventing it from pumping the liquid portions of the well fluid. Continued rotation of the impellers while gas locked can cause overheating of the ESP.

A variety of techniques may be employed to cause the pump to overcome a gas-locked condition. If the motor is powered by an electrical variable speed drive, the drive may change the frequencies of the three-phase power being supplied in order to cause the pump to again begin pumping. Many ESPs are driven at a constant speed however, rather than by a variable speed drive.

Some ESPs employ an external tube alongside the pump and motor to divert a portion of the well fluid being discharged to a point below the motor for cooling the motor. The diverted well fluid discharged by the external tube does not assist in re-priming of the pump if gas-locked.

U.S. Pat. No. 6,684,946 discloses another gas-lock re-priming solution. In that technique, a valve at an upper end of the pump shifts to deliver well fluid from the production tubing back down an external tube alongside the pump to the intake of the pump.

SUMMARY

An apparatus for pumping well fluid from a well comprises a centrifugal pump assembly having a shaft, impellers mounted to the shaft for rotation therewith, an intake at a second end of the pump assembly, and a discharge adapter at a first end of the pump assembly into which well fluid discharged by the impellers flows. A shaft passage extends into the shaft along a longitudinal axis of the pump assembly. The shaft passage has a first end in fluid communication with the well fluid in the discharge adapter. At least one outlet port extends laterally from the shaft passage to an inlet of at least one of the impellers. A gas-lock re-priming device in the shaft passage diverts a portion of well fluid in the discharge adapter through the shaft passage and out the outlet port.

In the embodiments shown the outlet port is adjacent the inlet of the impeller closest to the intake. In some of the embodiments, another one of the outlet ports is at an inlet of another one of the impellers. Also, in the embodiments shown, the shaft passage has a second end that is closed.

In one embodiment, the pump assembly comprises a first pump connected in tandem to a second pump. The shaft comprises a first shaft section in the first pump, a second shaft section in the second pump, and a coupling connecting the first shaft section to the second shaft section. The shaft passage extends through the first shaft section into the second shaft section. At least one outlet port is located adjacent an inlet of one of the impellers in the second pump.

A seal member in the shaft passage at a second end of the first shaft section and a first end of the second shaft section seals the shaft passage at a junction between the shaft passage in the first shaft section and the shaft passage in the second shaft section.

In some of the embodiments, the re-priming device comprises a pressure controlled valve in the shaft passage that is configured to close if a discharge pressure of the well fluid in the discharge adapter is above a selected level, blocking flow through the shaft passage. The valve opens if the discharge pressure is below the selected level. The valve may have a valve seat and an axially movable valve element relative to the shaft. A spring biases the valve away from the seat. The valve element may be positioned closer to the first end of the shaft than the valve seat.

Rather than a valve, the re-priming device may be an orifice member in the shaft passage. The orifice member has an open orifice passage for continuously diverting a selected portion of the well fluid in the discharge adapter through the shaft passage and out the outlet port.

Figure 1:
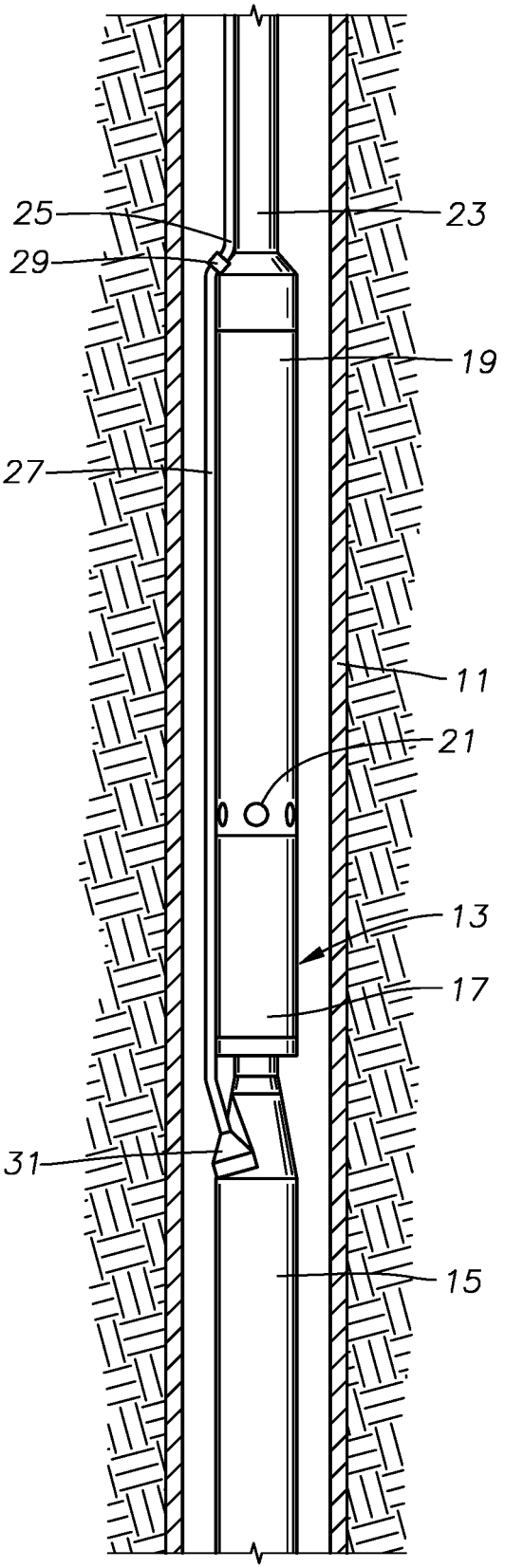
FIG. 1 is an schematic side view of an electrical submersible pump (ESP) having gas-lock re-priming features in accordance with this disclosure.

While the disclosure will be described in connection with the preferred embodiments, it will be understood that it is not intended to limit the disclosure to that embodiment. On the contrary, it is intended to cover all alternatives, modifications, and equivalents, as may be included within the scope of the claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates a cased well 11 having an electrical submersible well pump (ESP) 13 of a type commonly used to lift hydrocarbon production fluids from wells. ESP 13 has an electrical motor 15 coupled by a seal section 17 to a centrifugal pump 19. Pump 19 has intake ports 21 for drawing in well fluid and pumping it to a wellhead at the upper end of well 11. The terms "upward", "downward", "above", "below" and the like are used only for convenience as ESP 13 may be operated in other orientations, such as horizontal. In this example, pump 19 discharges into production tubing 23, which supports ESP 13 in well 11. Alternately, ESP 13 could be secured to a string of coiled tubing located within a production conduit. In that event, pump 19 would discharge into an annulus surrounding the coiled tubing within the production conduit.

In this example, power cable 25 extends downward alongside production tubing 23 to a splice 29 with a motor lead 27. Motor lead 27 has a connector 31 on its lower end that connects to motor 15. If the ESP is installed on coiled tubing, the power cable would be inside the coiled tubing and the motor would normally be above the pump.

Motor 15 contains a dielectric motor lubricant for lubricating the bearings within. A pressure equalizer communicates with the lubricant in motor 15 and with the well fluid for reducing a pressure differential between the lubricant in motor 15 and the exterior well fluid. In this example, the pressure equalizer is contained within seal section 17. Alternately, the pressure equalizer could be located below motor 15, and other portions of seal section 17 could be above motor 15.

Figure 2:
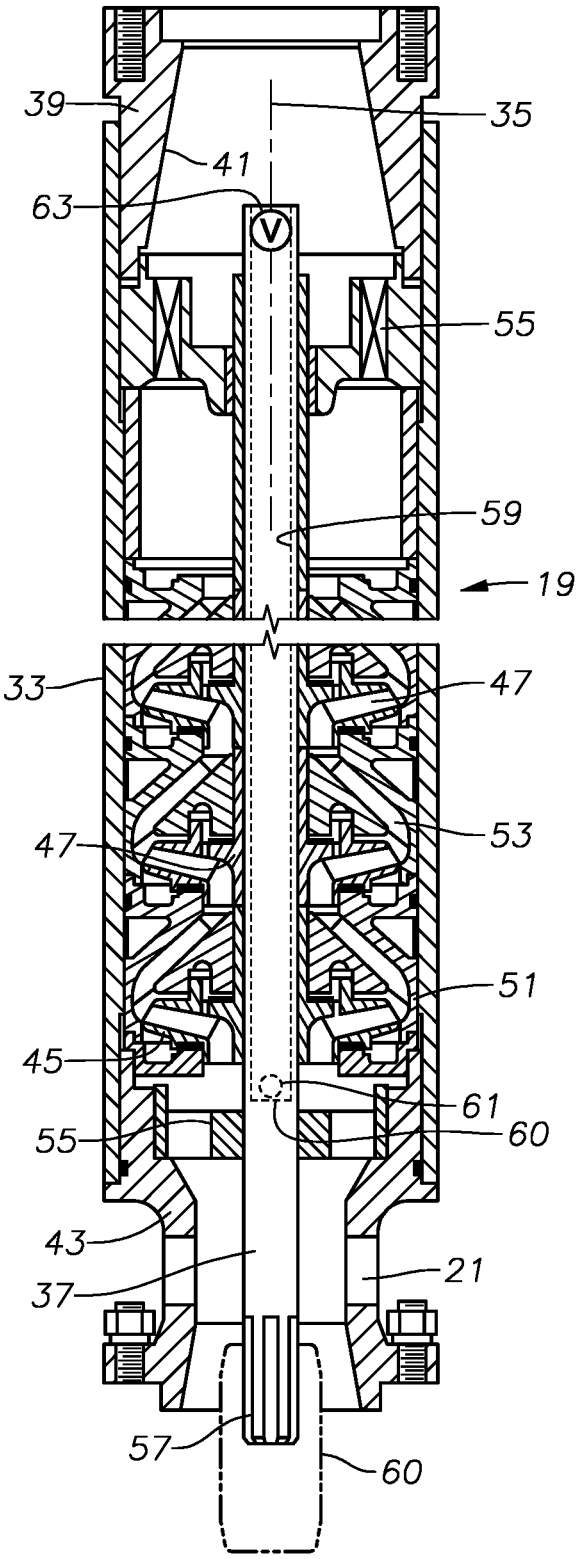
FIG. 2 is an axial sectional view of portions of the pump in FIG. 1.

Referring to FIG. 2, pump 19 is a centrifugal type having a tubular housing 33 with a longitudinal axis 35. An upper drive shaft section 37, which is part of a shaft assembly extending from motor 16, extends through housing 33 along axis 35. Pump 19 has an upper adapter 39 secured to an upper end of housing 33. Upper adapter 39 connects to and discharges well fluid into production tubing 23 in this example. Upper adapter 39 has a discharge bore 41 through which well fluid is discharged. Bore 41 may be conical and converging in an upward direction. A lower adapter 43 connects to a lower end of housing 33 for connecting pump 19 to a lower module, which is seal section 17 in this example. Intake ports 21 are located in lower adapter 43; alternately, they could be within a lower module, such as a gas separator. Upper and lower adapters 39, 43 are illustrated to have external flanges with bolt holes; alternately, they could have rotatable threaded collars.

Pump 19 is centrifugal type having a large number of stages. Each stage has an impeller 45 with impeller passages 47 extending upward and outward. Each impeller 45 has a hub 49 through which shaft 37 extends. A key and slot arrangement (not shown) between impeller hubs 49 and shaft 37 causes impellers 45 to rotate in unison with shaft 37. In this embodiment, each impeller 45 is free to slide upward and downward short distances on shaft 37 in response to up thrust and down thrust. Hubs 49 are illustrated to be able to abut each other; alternately, spacer rings (not shown) could be located between the adjacent hubs 49.

Each impeller 45 locates between two diffusers 51. Diffusers 51 are mounted in a stack within housing 33 so as to be non-rotatable relative to housing 33. Each diffuser 51 has diffuser passages 53 that extend upward and inward for receiving well fluid from a next lower or upstream impeller 45 and discharging it into a next upper or downstream impeller 45. FIG. 2 illustrates impeller passages 47 and diffuser passages 53 to be a mixed flow type extending generally radially and upward. Alternately, impeller passage 47 and diffuser passages 53 could be a radial flow type with passages 47, 53 being primarily radially oriented.

Upper and lower bearings 55 provide radial support to shaft 37. The upper bearing 55 is above the uppermost diffuser 51, and the lower bearing 55 is below the lowermost impeller 45. Each bearing 55 has slots or passages to allow the upward flow of well fluid. The upper end of shaft 37 is located within upper adapter bore 41. A lower end of shaft 37 has an externally splined lower end 57 that protrudes a short distance below lower adapter 43 for connecting via a coupling 60 to a shaft (not shown) of the next lower module, which is seal section 17 in this example.

Shaft 37 has a shaft passage 59 that is coaxial and has an open upper end within discharge bore 41. Shaft passage 59 extends below the lowermost or first impeller 45, and in the embodiment of FIG. 2, has a closed bottom 60 above splined lower end 58. One or more outlet ports 61 in shaft 37 extend laterally from shaft passage 59 near closed bottom 60 to a point near the inlet or low pressure area of the lowermost impeller 45. The upper end of shaft passage 59 has a normally open pressure controlled valve 63 in this embodiment.

Valve 63 will close during normal operation while the well fluid flowing into and being discharged from pump 19 is mostly liquid. During normal operation, the discharge pressure of pump 19 within discharge bore 41 will be sufficient to cause valve 63 to close. While valve 63 is closed, none of the well fluid being discharged by pump 19 into bore 41 will flow through shaft passage 59. Outlet port 61 at the lower end of shaft passage 59 will always be open; however, the pressure of well fluid in the inlet area of the lowermost impeller 45 will be much lower than the discharge pressure in bore 41 and will not cause valve 63 to move to its normally open position.

If a gas slug or pocket occurs in the incoming well fluid, it could result in the lower impellers 45 not pumping the gas pocket up through the stages of pump 19. The presence of the gas slug at the inlets of the lower impellers 45 could result in gas locking. When partly or fully gas locked, the pressure in discharge bore 41 drops even though shaft 37 continues to rotate. The drop in discharge pressure below a set pressure for valve 63 will cause valve 63 to move to the open position. When valve 63 is open, some of the well fluid in discharge bore 41 and in production tubing 23 will be diverted downward through shaft passage 59. The diverted well fluid, which is mostly liquid, flows through outlet port 61 into the inlet area of the lowermost impeller 45. The diverted well fluid displaces the accumulated gas in the inlet area of the lowermost impeller 45 and re-primes pump 19.

Pump 19 will again begin pumping well fluid without having to slow the speed of shaft 37 or stop it from rotating in order to re-prime.

If fully gas locked, the downward flow in shaft passage 59 will come from the well fluid in discharge bore 41 and production tubing 23 flowing downward by gravity. If only partially gas locked and while valve 63 is open because of the low discharge pressure, pump 19 may simultaneously continue to pump some well fluid out discharge bore 41 and up production tubing 23. As an example only, valve 63 may be preset to close when the pressure in discharge bore 41 above valve 63 is 400 psi greater than the pressure in shaft passage 59 directly below valve 63.

Valve 63 may have a variety of configurations. In the schematic example of FIGS. 3 and 4, valve 63 includes a seat 65 secured in shaft passage 47. Seat 65 has an orifice 67 that may be partially spherical with a larger diameter on its upper end. An axially movable valve element 69 engages seat 65 to block flow through orifice 67 while in the closed position shown in FIG. 3. Valve element 69 is illustrated as having a semi-spherical lower portion and a cylindrical upper portion, but it may have different shapes. A retainer 71 having slots 72 through it is secured above valve element 69. A spring 74 is stretched between retainer 71 and the upper end of valve element 74.

Figure 3:
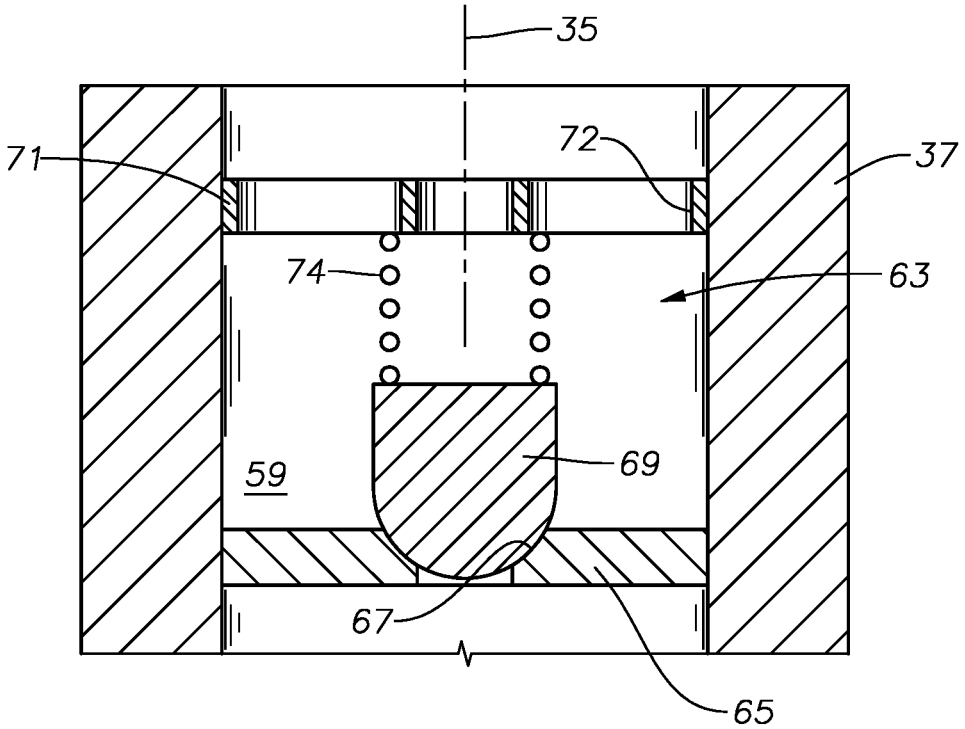
FIG. 3 is a sectional view of a gas-lock re-priming device of the pump of FIG. 2, shown in a closed position.
Figure 4:
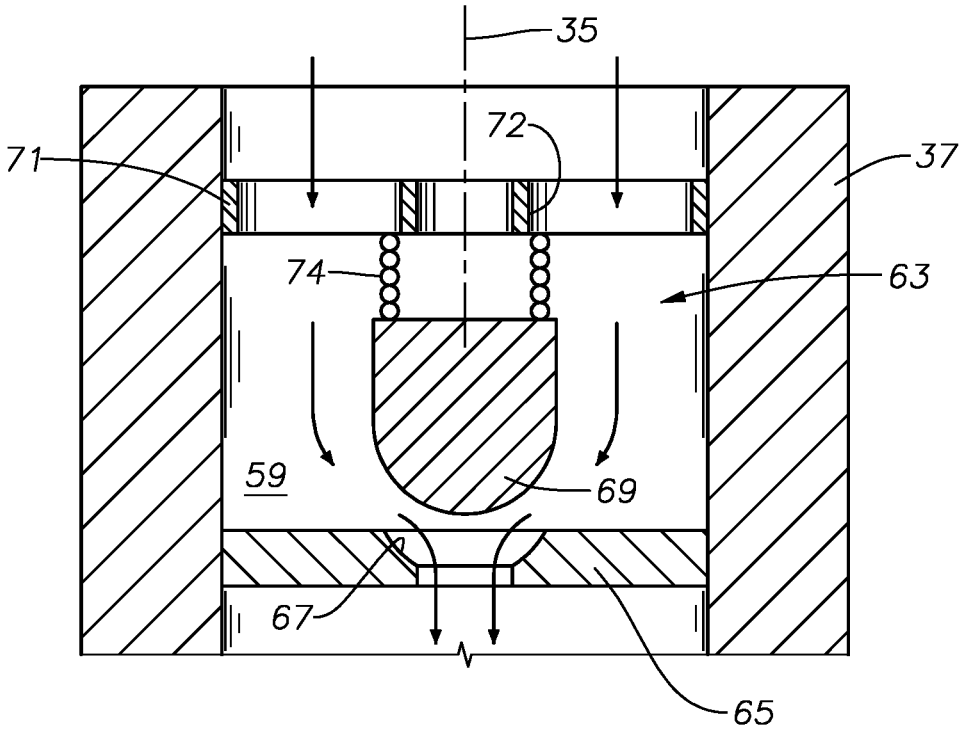
FIG. 4 is a sectional view of the re-priming device of FIG. 3, shown in an open position.

In this example, spring 74 will be in tension while in the closed position of FIG. 3. Spring 74 thus exerts an upward pulling force on valve element 74 toward the retracted position of FIG. 4. The discharge pressure in bore 41 (FIG. 2) will overcome the bias of spring 74 when above the spring set point, causing valve element to close, as shown in FIG. 3. When the discharge pressure drops below the spring set point, the bias of spring 74 causes it to retract, lifting valve 69 from seat 65 and opening valve 63. The set point may be adjusted either by using different strengths for spring 74 or by changing the distance between retainer 71 and seat 65. In this example, the spring set point will be fixed prior to installing ESP 13 in well 11.

Figure 5:
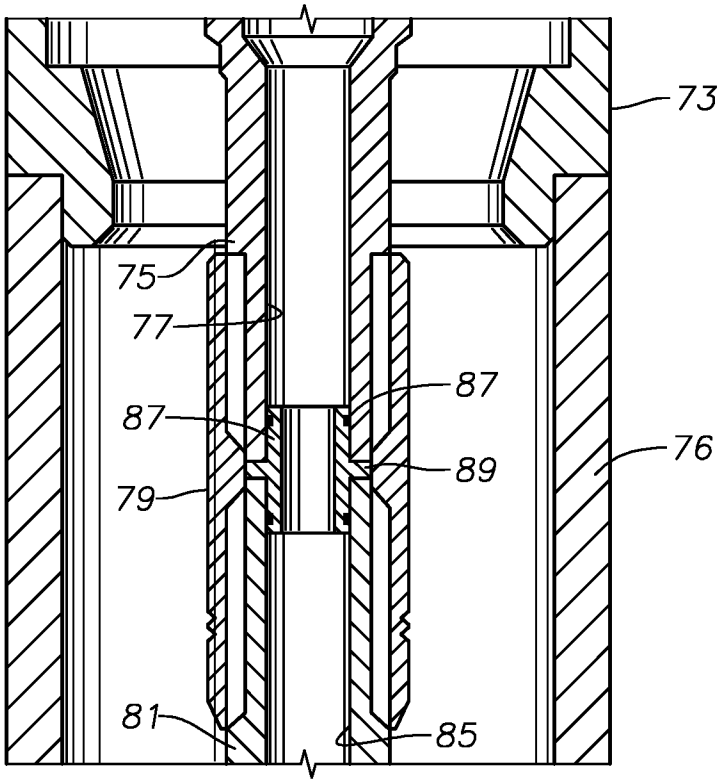
FIG. 5 is a sectional view of a lower end of an alternate embodiment pump having the gas-lock re-priming features of FIG. 2, but modified for connection to a lower tandem pump.

FIG. 5 shows an embodiment where the ESP has an upper pump 73 and a lower pump 76 connected in tandem. Upper pump 73 and lower pump 76 are also centrifugal pumps having stages of impellers and diffusers. In this example, intake ports 21 (FIG. 2) will only be present at the lower end of lower pump 76, or in a gas separator secured to the lower end of lower pump 76. Upper pump 73 has an upper shaft section 75 with an upper shaft passage 77 that extends completely through the length of upper shaft section 75. Valve 63 (FIG. 2) will be located at the upper end of upper shaft passage 77. When valve 63 is open, well fluid will be free to flow downward through the open lower end of upper shaft passage 77. In this example, there is no outlet port for upper shaft passage 77, such as outlet port 61 (FIG. 2), located above the lower end of upper shaft section 75.

An internally splined coupling 79 joins the externally splined lower end of upper shaft section 75 to the externally splined upper end of a lower shaft section 81 in lower pump 76. Lower shaft section 81 has an axially extending lower shaft passage 85. A seal member 87 fits within coupling 79 and seals a junction of the abutting upper and lower shaft passages 77, 85. Seal member 87 has external seal rings 87 that seal to the inner walls of upper and lower shaft passages 77, 85. Seal member 87 may also have an external flange 89 that is clamped between the lower end of upper shaft section 75 and the upper end of lower shaft section 85.

Although not shown, an outlet port for lower shaft passage 85 will be at an inlet area of the lowermost impeller within lower pump 76. The outlet port would be similar to or the same as outlet port 61 (FIG. 2). Additional outlet ports could be in either shaft section 75, 81 above the lowermost outlet port. Similar to the FIG. 2 embodiment, lower shaft passage 85 has a closed bottom below the lowermost outlet port. A pressure controlled valve (not shown) similar to valve 63 (FIG. 3) may be located at the upper end of upper shaft passage 77. The valve will open to admit well fluid to flow down shaft passages 77, 85 when gas locking conditions occur.

Figure 6:
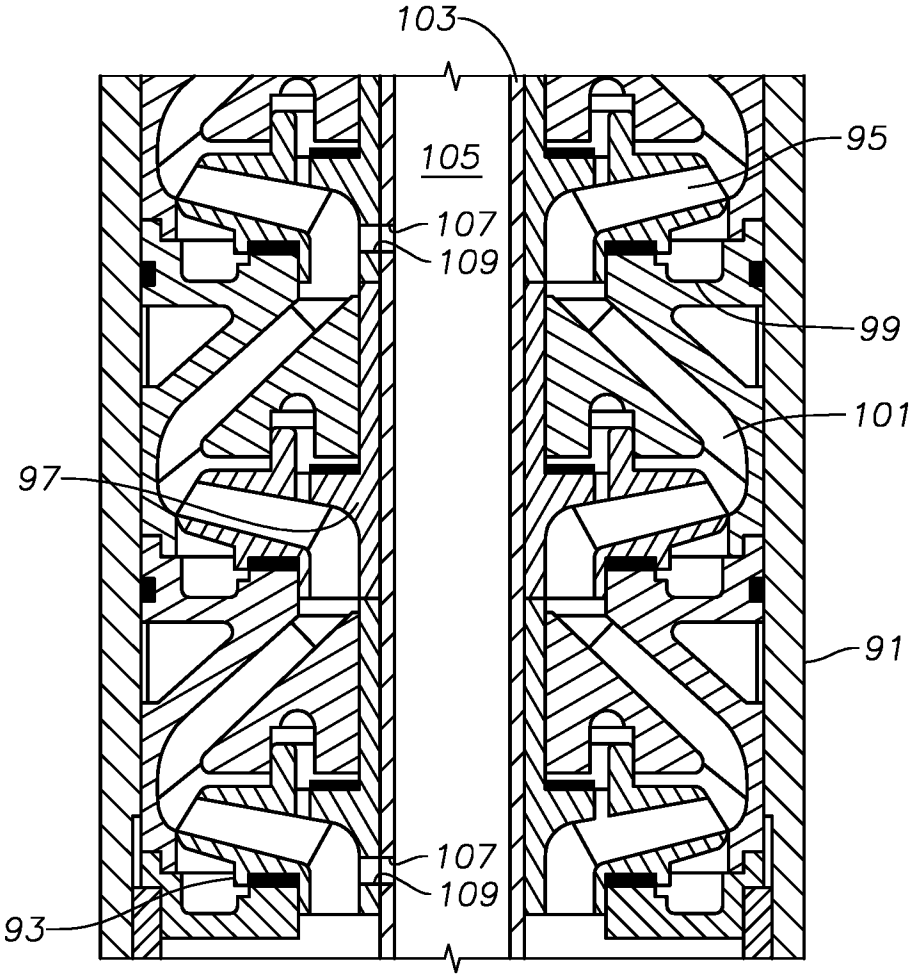
FIG. 6 is a sectional view of a portion of another alternate embodiment of a pump having gas-lock re-priming features.

Referring to the embodiment of FIG. 6, centrifugal pump 91 also has numerous stages, each having an impeller 93 with impeller passages 95 that extend upward and outward. Each impeller has a hub 97. Hubs 97 of adjacent impellers 93 may abut either other, as shown, or they may be separated from each other by spacer sleeves (not shown). Each impeller 93 locates between two diffusers 99. Each diffuser 99 is non-rotating and has diffuser passages 101 that extend upward and inward. A drive shaft 103 extends through impeller hubs 97, which rotate with shaft 103. Shaft 103 has an axially extending shaft passage 105.

Rather than only one outlet port from shaft passage 105, as in the embodiment of FIG. 2, there will be at least two shaft outlet ports 107, as shown, and possibly many more. Shaft outlet ports 107 could be axially spaced along substantially a full length of the stages of pump 91. Each shaft outlet port 107 is located in a different pump stage. In this example, three pump stages are illustrated, with shaft 103 having shaft outlet ports 107 in the lower and the upper stages, but not the intermediate stage.

A hub port 109 within at least some of the impeller hubs 97 aligns with each shaft outlet port 107 to simultaneously deliver re-priming well fluid from shaft passage 105 to the intake areas of more than one impeller 93. Hub ports 109 could alternately be located in spacer tubes between impeller hubs 97. Hub ports 109 may be axially elongated slots, having an axial length longer than the diameter of outlet ports 107, to accommodate axial floating movement of impeller hubs 49 on shaft 103 during up thrust and down thrust. Alternately, in order to maintain each hub port 109 in alignment with one of the shaft outlet ports 107, it may be necessary to rigidly secure impellers 93 to shaft 103 to prevent axial movement along shaft 103. If so, unlike pump 19 of FIG. 2, impellers 93 would not be able to float or move axially small increments to transfer thrust to an adjacent diffuser 99. Rather all of the up thrust and down thrust of each impeller 93 would transfer to shaft 103.

Pump 91 could be either a single pump within the ESP, as shown in FIG. 2, or it could be one or both of the tandem pumps, as shown in FIG. 5. If pump 91 is not mounted in tandem to another pump below it, shaft passage 105 would have a closed bottom below the lowermost impeller 93. A pressure controlled normally open valve similar to valve 63 (FIG. 2) would be at the upper end of shaft passage 105. If pump 91 is a lower tandem pump, such as pump 76 (FIG. 5), it would contain multiple outlet ports 107 and hub ports 109. The upper tandem pump in such an arrangement may not have any shaft outlet ports 107 and hub ports 109. Optionally, the upper tandem pump could also have one or more shaft and hub outlet ports 107, 109.

Figure 8:
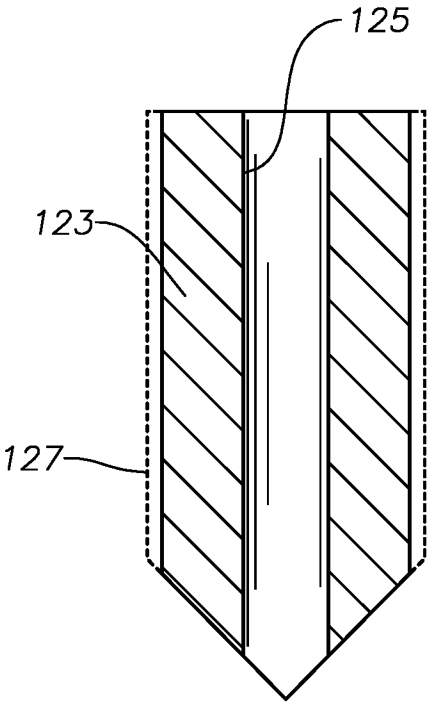
FIG. 8 is an enlarged sectional view of the gas-lock re-priming device of FIG. 7, shown removed from the pump.
Figure 7:
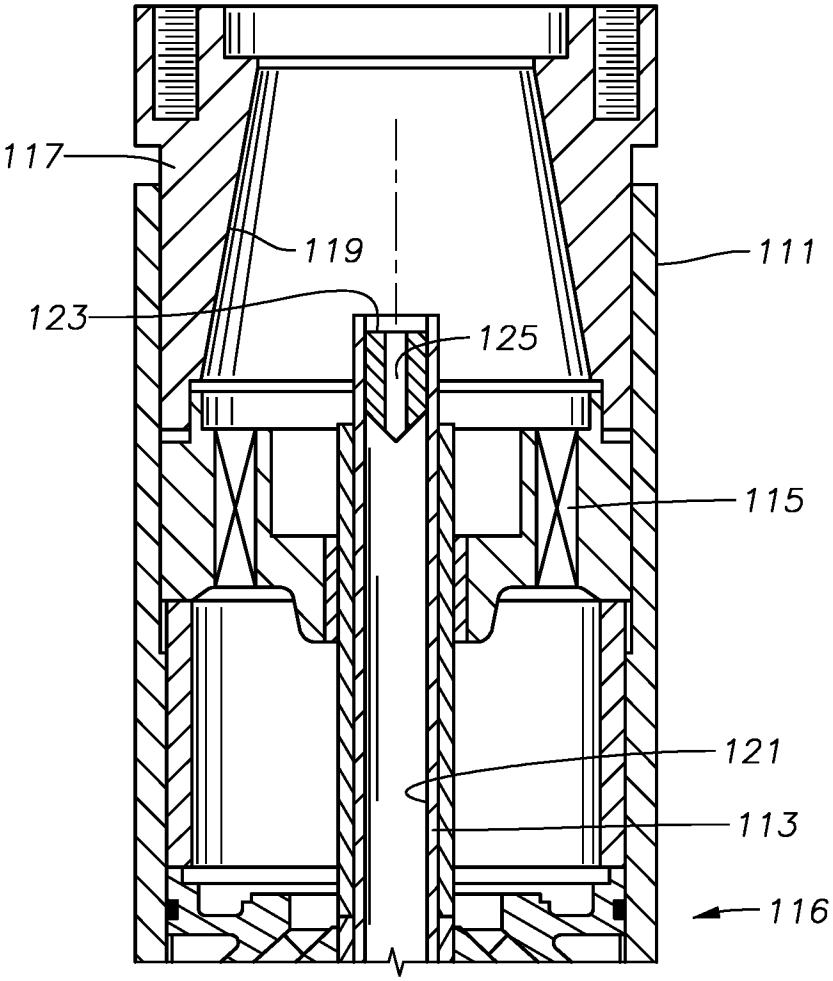
FIG. 7 is a sectional view of an upper portion of a pump having another alternate embodiment of a gas-lock re-priming device.

Referring to FIGS. 7 and 8, in this embodiment pump 111 has a shaft 113 supported at its upper end by a top bearing 115, as in the other embodiments. A stack of pump stages 116 are located below top bearing 115, each pump stage having an impeller and a diffuser. A discharge adaptor 117 above top bearing 115 has a converging bore 119 through which the well fluid pumped by pump stages 116 flows. Shaft 113 has a shaft passage 121 with an open upper end in discharge adapter bore 119. As in the embodiment of FIG. 2, shaft passage 121 an outlet port for diverting well fluid from discharge adapter bore 119 out of shaft passage 121 adjacent the inlet of the lowermost pump stage 116. Unless coupled to a lower tandem pump or to a gas separator, shaft passage 121 would have a closed bottom above the outlet port.

Rather than a valve, as in the other embodiments, the gas lock re-prime device in this embodiment comprises an orifice member 123 installed in the open upper end of shaft passage 121. Orifice member 123 has an orifice passage 125 extending axially through it with open upper and lower ends. Orifice member 123 may have threads 127 on its outer diameter for engaging mating threads provided in shaft passage 121. Other ways to install orifice member 123 in shaft passage 121 are feasible. Prior to installing pump 111, an operator may select and install an orifice member 123 with a desired diameter of orifice passages 125 based on the capacity of the particular pump 111. Orifice member 123 may be formed from a variety of materials.

Orifice passage 125 is much smaller in diameter than shaft passage 121, and it is continuously open. For example, the diameter of orifice passage 125 may be selected to allow a flow rate of well fluid from discharge adapter bore 119 down orifice passage 125 that will not exceed five percent of the flow rate of well fluid from pump stages 116 up discharge bore 119.

An outlet port, such as outlet port 61 in FIG. 2, is also continuously open. Consequently, orifice member 123 recirculates a small portion of well fluid being discharged into discharge adapter bore 119 to one or more outlet ports 61 (FIG. 2). In the event of a gas slug entering pump stages 116, the continuously recirculated well fluid assists in re-priming of the impeller of the lowest pump stage 116. Orifice member 123 may be substituted for valve 63 in all of the embodiments described above.

The present disclosure described herein, therefore, is well adapted to carry out the objects and attain the ends and advantages mentioned, as well as others inherent therein. While a few embodiments of the disclosure have been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. An apparatus for pumping well fluid from a well, comprising:

a centrifugal pump assembly having a shaft, impellers mounted to the shaft for rotation therewith, an intake at a second end of the pump assembly, and a discharge adapter at a first end of the pump assembly into which well fluid discharged by the impellers flows;

a shaft passage extending into the shaft along a longitudinal axis of the pump assembly, the shaft passage having a first end in fluid communication with well fluid in the discharge adapter;

at least one outlet port extending laterally from the shaft passage to an inlet of at least one of the impellers; and a gas-lock re-priming device in the shaft passage for diverting a portion of well fluid in the discharge adapter through the shaft passage and out the outlet port.

2. The apparatus according to claim 1, wherein at least one of the outlet ports is adjacent the inlet of the impeller closest to the intake.

3. The apparatus according to claim 1, wherein the re-priming device is located in the shaft passage closer to the discharge adapter than any of the impellers.

4. The apparatus according to claim 2, wherein another one of the outlet ports is at an inlet of another one of the impellers.

5. The apparatus according to claim 1, wherein:

the pump assembly comprises a first pump connected in tandem to a second pump;

the shaft comprises a first shaft section in the first pump, a second shaft section in the second pump, and a coupling connecting the first shaft section to the second shaft section;

the shaft passage extends through the first shaft section into the second shaft section; and the outlet port is located adjacent an inlet of one of the impellers in the second pump.

6. The apparatus according to claim 5, further comprising:

a seal member in the shaft passage at a second end of the first shaft section and a first end of the second shaft section, the seal member sealing a junction between the shaft passage in the first shaft section with the shaft passage in the second shaft section.

7. The apparatus according to claim 1, wherein the shaft passage has a second end that is closed.

8. The apparatus according to claim 1, wherein the re-priming device comprises:

a pressure controlled valve in the shaft passage that is configured to close if a discharge pressure of well fluid in the discharge adapter is above a selected level, blocking flow through the shaft passage, and to open if the discharge pressure is below the selected level.

9. The apparatus according to claim 1, wherein the re-priming device comprises:

a valve seat;

an axially movable valve element relative to the shaft; and a spring that biases the valve element away from the seat.

10. The apparatus according to claim 1, wherein the re-priming device comprises:

a valve seat;

a valve element positioned closer to the first end of the shaft than the valve seat; and a spring that urges the valve element away from the valve seat.

11. The apparatus according to claim 8, wherein the pressure control valve comprises:

a retainer secured in the shaft passage, slots formed through the retainer, a valve seat in the shaft passage disposed between the retainer and the outlet port, an orifice formed through the valve seat, a valve element coupled to and biased towards the retainer, so that when pressure in the slots exceeds pressure at the outlet, the valve element lands in the orifice to block communication between the slots and the outlet port.

12. An apparatus for pumping well fluid from a well, comprising:

a centrifugal pump assembly having a shaft with a longitudinal axis, impellers mounted to the shaft for rotation therewith, a discharge adapter at an upper end of the pump assembly with a discharge adapter bore into which well fluid discharged by the impellers flows;

a shaft passage in the shaft, the shaft passage having an open upper end above the impellers and a closed lower end below the impellers;

at least one outlet port extending laterally from the shaft passage below the impellers; and a gas-lock re-priming device in the shaft passage for diverting a portion of well fluid in the discharge adapter bore through the shaft passage and out the outlet port.

13. The apparatus according to claim 12, wherein another one of the outlet ports is above said first mentioned outlet port and at an inlet of another one of the impellers.

14. The apparatus according to claim 12, wherein:

the pump assembly comprises an upper pump connected in tandem to a lower pump;

the shaft comprises an upper shaft section in the upper pump, a lower shaft section in the lower pump, and a coupling connecting the upper shaft section to the lower shaft section;

a seal member seals a portion of the shaft passage in the upper shaft section to a portion of the shaft passage in the lower shaft section; and the at least one outlet port is located adjacent an inlet of one of the impellers in the lower pump.

15. The apparatus according to claim 12, wherein the re-priming device comprises:

a pressure controlled valve in the shaft passage that is closed if a discharge pressure of the well fluid in the discharge adapter bore is above a selected level and open if the discharge pressure is in the discharge adapter bore is below the selected level.

16. The apparatus according to claim 12, wherein the re-priming device comprises:

a valve seat;

an axially movable valve element; and a spring that biases the valve element away from the seat.

17. The apparatus according to claim 12, wherein the re-priming device comprises:

an orifice member in the shaft passage, the orifice member having an orifice passage for continuously diverting a selected portion of the well fluid in the discharge adapter through the shaft passage and out the outlet port.

18. A method for pumping well fluid from a well with a centrifugal pump assembly having a shaft, impellers mounted to the shaft for rotation therewith, and a discharge adapter at a first end of the pump assembly into which well fluid discharged by the impellers flows, the method comprising;

providing the shaft with a shaft passage along a longitudinal axis of the pump assembly and at least one outlet port extending laterally from the shaft passage to an inlet of at least one of the impellers;

installing in the shaft passage a gas-lock re-priming device; and diverting a portion of well fluid in the discharge adapter through the shaft passage and out the outlet port.

19. The method according to claim 18, wherein:

installing a gas-lock re-priming device comprises installing a valve in the shaft passage that is biased to a closed position; and diverting a portion of the well fluid comprises moving the valve to an open position in response to a drop in pressure of the well fluid in the discharge adapter below a selected level.

20. The method according to claim 18, wherein:

installing a gas-lock re-priming device comprises inserting an orifice member with an orifice passage into the shaft passage; and diverting a portion of the well fluid comprises continuously recirculating a portion of the well fluid through the shaft passage and out the outlet port.

* * * * *